United States Patent [19]

Bentley

[11] Patent Number: 4,492,528

[45] Date of Patent: Jan. 8, 1985

[54] PRESSURE BALANCED LIQUID ELEVATING MECHANISM

[76] Inventor: Arthur P. Bentley, P.O. Box 6791, Great Falls, Mont. 59406

[21] Appl. No.: 482,490

[22] Filed: Apr. 6, 1983

[51] Int. Cl.[3] ..... F04F 7/00; F04B 35/02

[52] U.S. Cl. ..... 417/241; 417/377; 417/378

[58] Field of Search ..... 417/240, 241, 377, 378

[56] References Cited

U.S. PATENT DOCUMENTS 2,562,584 7/1951 Soberg ..... 417/378
3,838,945 10/1974 Moore ..... 417/378
4,013,385 3/1977 Peterson ..... 417/378
4,234,294 11/1980 Jensen ..... 417/377

FOREIGN PATENT DOCUMENTS 2100362 12/1982 United Kingdom ..... 417/377

*Primary Examiner*—William L. Freeh
*Attorney, Agent, or Firm*—Herbert E. Haynes, Jr.

[57] ABSTRACT

A liquid elevating mechanism for use with pumps of the type which produce cyclic pressure waves for transmission through a liquid column to the liquid elevating mechanism for operation thereof. The liquid elevating mechanism is especially configured to utilize the head pressure forces exerted thereon by the liquid column for head pressure counterbalancing purposes.

17 Claims, 8 Drawing Figures

PRESSURE BALANCED LIQUID ELEVATING MECHANISM

BACKGROUND OF THE INVENTION

1. Field of the Invention

This invention relates in general to pumps and more particularly to an improved liquid elevating mechanism for use with pressure wave operated pumps.

2. Description of the Prior Art

Pressure wave operated pumps of the type commonly used, for example, in pumping liquid, such as water and oil, to the ground surface from subterranean sources of the liquid are of two basic classes, namely those which operate on hydraulic pressure waves and those which operate on what is referred to as sonic pressure waves.

In the case of hydraulic pressure wave operated pumps, an above ground power input mechanism is operated to cyclically impact a column of liquid which extends downwardly through a first pipe to a subterranean liquid elevating mechanism. By impacting the column of liquid, hydraulic pressure wave pulses are generated and transmitted by the liquid column to reciprocally operate the below ground liquid elevating mechanism. The liquid elevating mechanism includes a plunger, or similar mechanism, having a central passage with a check valve in the lowermost end. When the hydraulic pressure waves impact on the plunger causing it to move downwardly, the check valve will be opened to admit the liquid to be pumped into the central passage of the plunger, and the subsequent upstroke of the plunger, i.e., between each hydraulic pressure wave, causes a general upward movement of the liquid in the central passage of the plunger, and this liquid moves to the ground level through a second pipe. Examples of specific pumps which operate on this general principle are disclosed, for example in U.S. Pat. Nos.: 2,379,539, 2,572,977, 2,751,848 and 3,277,831.

Pumps which operate on which is commonly referred to as sonic pressure waves have a single tube, referred to as a production tube, extending between the above ground power input mechanism and the below ground liquid elevating mechanism. The power input mechanism is of special configuration to cyclically impact the column of liquid in the production tube and produce pressure wave pulses which are believed to be sonic in nature. Those sonic pressure waves move downwardly about the periphery of the liquid column to reciprocally operate the plunger in the liquid elevating mechanism in the same manner as described above, and the sonic pressure waves are reflected upwardly and centrally through the production tube to carry the liquid being pumped to the ground surface. Examples of pumps which operate on this basic principle are disclosed in U.S. Pat. Nos.: 4,295,799 and 4,341,505.

In both of the above described types of pumps, the plungers of the underground liquid elevating mechanisms must be biased upwardly an amount which corresponds approximately to the downwardly exerted forces bearing thereon as a result of the head pressure of the column of liquid. The upward biasing force applied to the plunger must be slightly greater than the head pressure so that the plunger will move upwardly to the limit of its travel between each pressure wave, and this bias must be just slightly greater than the head pressure so that the pressure waves will reciprocally drive the plunger to the downward limit of its travel.

The head pressure exerted on the plungers of the liquid elevating mechanism is, of course, a function of the depth of the well and the counterbalancing biasing force applied to the plunger must be reduced or increased in accordance with the depth of the well. Heretofore the counterbalancing biasing force was accomplished by compression spring assemblies which were added to or removed from the liquid elevating mechanism as needed. There are several problems associated with the compression spring assemblies. The first problem is obtaining springs of relatively consistent force exerting value so that an accurate and known consistent amount of biasing force can be added to or removed from the liquid elevating mechanism. The second problem concerns the spring mounting apparatus per se, which must be configured to position the springs so that they cumulatively bear against the plunger and yet the apparatus must be relatively small in diameter so as not to cause problems with regard to the passage of the liquid elevating mechanism through the well casing during installation and removal from a well. Further, the spring assemblies should be as light in weight as possible, so as not to cause problems with regard to the suspended supporting of the liquid elevating mechanism within the well. Also, the springs must be capable of withstanding the deteriorating effects of the liquids being pumped, such as sour crude oil, must resist embrittlement, and the like. And of course, springs meeting such requirements are expensive.

Therefore, a need exists for a new and useful liquid elevating mechanism which overcomes some of the problems and shortcomings of the prior art.

SUMMARY OF THE INVENTION

In accordance with the present invention, new and improved liquid elevating mechanisms are disclosed for use in pumps of the types which are operated by hydraulic pressure waves and by sonic pressure waves, with the improved liquid elevating mechanism being configured to utilize head pressure exerted forces for counterbalancing purposes in place of the spring assemblies of the prior art.

A first embodiment of the improved liquid elevating mechanism of the present invention is suitable for use in the types of pumps which are operated by sonic pressure waves. As hereinbefore briefly discussed, sonic pressure wave pulses are generated by an especially configured above ground power input mechanism and are transmitted through a column of liquid contained in a single tube, which is referred to as the production tube, to the liquid elevating mechanism. The sonic pressure waves impactingly operate the plunger assembly of the liquid elevating mechanism and are reflected back through the production tube and carry the liquid being pumped to the ground surface.

The liquid elevating mechanism of this first embodiment includes a plunger assembly which is reciprocally movable in a cylindrical housing with the plunger assembly having a counterbalancing piston which is connected by a tubular stem to a production piston. An axial passage extends through the counterbalancing piston, through the interconnecting stem and through the production piston, and a check valve means is provided in the production piston so as to allow the liquid being pumped to move upwardly into the axial passage during a downstroke of the plunger assembly and prevent reverse liquid flow during an upstroke of the plunger assembly. A special arrangement of seals and ports are provided in the liquid elevating mechanism so that the head pressure resulting from the column of liquid is exerted on the opposite end surfaces of the counterbalancing piston and is kept from being exerted on the production piston. The upper end surface of the counterbalancing piston has a smaller surface area than the bottom surface which results in the head pressure exerting more force on the bottom surface of the counterbalancing piston than on the top surface thereof. However, the counterbalancing piston is intentionally weighted so that the entire plunger assembly will be biased downwardly in the absence of sonic pressure wave pulses. The counterbalancing piston is configured so that weights may be added to or removed therefrom to adjust for the head pressures of different depth wells.

When the plunger assembly moves down, i.e., between the sonic pressure wave pulses, the check valve means opens admitting the liquid to be pumped into the axial passage through the plunger assembly. When a sonic pressure wave pulse impinges on the plunger assembly, it will exert a greater force on the larger area bottom surface of the counterbalancing piston causing it to move up against the downward bias thereof. In moving up, the check walve means closes so that the liquid admitted to the axial passage of the plunger during the previous downstroke thereof will move upwardly with the plunger and will be carried up the production tube by the reflected sonic pressure waves.

A second embodiment of the improved elevating mechanism of the present invention is suitable for use in the types of pumps which are operated by hydraulic pressure waves. As hereinbefore briefly discussed, hydraulic pressure wave pulses are generated by an above ground power input unit and are transmitted by a column of liquid contained in a first tube, hereinafter referred to as the signal tube, to the liquid elevating mechanism. The hydraulic pressure waves impactingly operate the plunger assembly of the liquid elevating mechanism causing it to pumpingly elevate the pumped liquid to the ground surface through a second, or production tube.

The liquid elevating mechanism of this second embodiment includes the plunger assembly which is reciprocally movable in a cylindrical housing with the plunger assembly having a counterbalancing piston connected by a tubular stem to a production piston. A first axial passage is formed in the plunger assembly so as to have its upper end in liquid communication with the signal tube and to have its lower end in liquid communication with a chamber immediately below the counterbalancing piston. In this manner, the head pressure of the column of liquid contained in the signal tube will be exerted on the bottom surface of the counterbalancing piston. A second axial passage is formed in the plunger assembly so as to have its upper end in liquid communication with a chamber provided immediately above the counterbalancing piston with this same chamber being in liquid communication with the production tube. In this manner, the head pressure of the column of liquid contained in the production tube will be exerted on the top surface of the counterbalancing piston. A check valve means is provided in the plunger assembly at the lower end of the second axial passage to admit pumped liquid thereto during the downstroke of the plunger assembly and prevent reverse liquid flow during the upstroke.

The top surface area of the counterbalancing piston is relatively larger than the bottom surface area thereof, and since the head pressure exerted by the liquid column in the signal tube is approximately equal to the head pressure exerted by the liquid column in the production tube, the plunger assembly will be biased downwardly due to the relatively large top surface area of the counterbalancing piston. Therefore, in the absence of hydraulic pressure waves, i.e., between each pulse, the plunger assembly will move downwardly under the influence of the head pressure induced biasing force and each of these downstrokes will admit pumped liquid into the second axial passage through the check valve means. Upon the occurrence of each hydraulic pressure wave pulse, the plunger assembly will move up against the biasing force, in that the force exerted by the hydraulic pressure waves will be exerted only on the bottom surface area of the counterbalancing piston. When the plunger assembly moves upwardly, the check valve means will close causing the pumped liquid admitted to the second axial passage in the previous downstrokes to move upwardly with the plunger assembly through the chamber provided above the counterbalancing piston and through the production tube to the ground surface.

The above described second embodiment of the liquid elevating mechanism is designed as seen from the above description to operate in conjunction with the two tubes, i.e., signal and production tubes, of hydraulic pressure wave operated pumps. However, the liquid elevating mechanism of the present invention may be operated in conjunction with an accumulator mechanism which eliminates the need for two separate tubes throughout the greater part of the length of the well casing.

The accumulator mechanism is connected to the liquid elevating mechanism by a signal transmitting tube and a production tube so that the liquid elevating mechanism will function in the hereinbefore described manner. However, the accumulator mechanism is connected to the above ground power input mechanism by a single tube which transmits the hydraulic pressure waves to the accumulator upon the occurrence of such pressure waves with the accumulator relaying those pressure waves to the liquid elevating mechanism. The upward movement of the pumped liquid which occurs simultaneously with the occurrence of the hydraulic pressure waves, moves through the production tube and causes a weighted accumulator piston to move upwardly to receive and store the upwardly moving pumped liquid. When the hydraulic pressure wave subsides, the weighted accumulator piston moves downwardly under the influence of gravity, and forces the pumped liquid, received during the occurrence of the hydraulic pressure wave, into and upwardly through the single tube which connects the accumulator mechanism with the above ground input mechanism. The weighted accumulator piston is configured so that weights may be added to or removed from the piston so that it will properly operate in wells of various depths.

Accordingly, it is an object of the present invention to provide new and improved liquid elevating mechanism for use with pressure wave operated pumps.

Another object of the present invention is to provide new and improved liquid elevating mechanisms which are configured to utilize head pressure exerted forces for head pressure counterbalancing purposes rather than the spring assemblies of the prior art.

Another object of the present invention is to provide a new and improved liquid elevating mechanism for use with sonic pressure wave single tube surface operated pumps wherein head pressure forces exerted in the liquid elevating mechanism are biasingly counterbalanced by a head pressure sensing counterbalancing piston provided therein.

Another object of the present invention is to provide a new and improved liquid elevating mechanism of the above described character wherein the counterbalancing piston is adjustably weighted for proper operation in wells of different depths.

Another object of the present invention is to provide a new and improved liquid elevating mechanism for use with hydraulic pressure wave two tube surface operated pumps wherein head pressure forces exerted in the liquid elevating mechanism are biasingly counterbalanced by a head pressure sensing counterbalancing piston provided therein.

Still another object of the present invention is to provide a new and improved liquid elevating mechanism of the above described type for use in hydraulic pressure wave two tube surface operated pumps, wherein the liquid elevating mechanism may be used in conjunction with an accumulator mechanism which allows this type of pump to employ a single tube over the greatest part of the well depth.

Yet another object of the present invention is to provide a new and improved liquid elevating mechanism of the above described character wherein the accumulator mechanism is adjustably weighted for proper operation in wells of different depths.

The foregoing and other objects of the present invention as well as the invention itself may be more fully understood from the following description when read in conjunction with the accompanying drawings.

DESCRIPTION OF THE PREFERRED EMBODIMENTS

Figure 1:
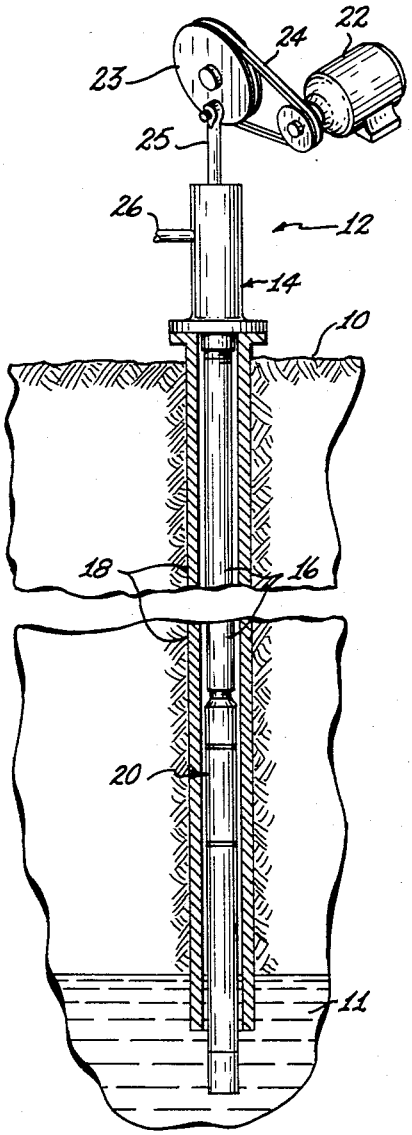
FIG. 1 is a diagrammatic view illustrating a sonic pressure wave single tube surface operated pump in a typical well installation with the pump being provided with a first embodiment of the improved liquid elevating mechanism of the present invention.

Referring more particularly to the drawings, FIG. 1 illustrates a ground formation having a surface level 10 and an underground level 11 containing liquid which is to be pumped, such as water, oil, and the like. A sonic pressure wave single tube surface operated pump 12 is seen to be located in the ground formation in a conventional manner, and the pump includes an above ground sonic pressure wave generator 14 from which a single tube 16 depends, with that tube hereinafter being referred to as the production tube. The production tube 16 extends downwardly from the generator 14 through a conventional well casing 18 with the liquid elevating mechanism 20 of the present invention suspendingly mounted on the lower end of the production tube 16 so that the lower end of the liquid elevating mechanism 20 is in liquid communication with the liquid to be pumped.

It will be noted that the generator 14 of the sonic pressure wave pump 12 is not part of the present invention and is shown in FIG. 1 in that it is necessary for operation of the liquid elevating mechanism 20 of this invention. Detailed disclosure of the various elements and operation theory of the sonic pressure wave pump is presented in the hereinbefore referenced U.S. Pat. Nos. 4,295,799 and 4,341,505. However, to insure a clear understanding of the present invention, a brief operational description of sonic pressure wave pumps will now be presented.

Before proceeding, it should be noted that the exact nature of the generated pressure waves and precisely what occurs in sonic pressure wave pumps is not clearly understood and that the following is based on theory and pump performance.

A suitable drive mechanism 22, such as the illustrated electric motor, is employed to rotatably drive a flywheel 23 by means of a suitable belt 24. A crank arm 25 is eccentrically mounted on the flywheel by a suitable pivot pin so as to reciprocally drive the sonic pressure wave generator 14. The crank arm 25 reciprocally drives an especially configured piston (not shown) in the generator to cyclically open and close a liquid output line 26 and to cyclically impact a column of liquid (not shown). The column of liquid is present in the lower portions of the generator 14, in the production tube 16 and in the liquid elevating mechanism 20. Each time the special piston (not shown) impacts the column of liquid, a pressure wave, which is believed to be sonic in nature, is generated. The sonic pressure waves move downwardly in a spiral-like movement path about the inner wall of the production tube 16. Upon reaching the liquid elevating mechanism 20, the sonic pressure waves impactingly operate that mechanism and are reflected back centrally through the production tube and, the liquid being pumped is carried by those reflected sonic pressure waves back to the generator 14 and exit the generator 14 through the liquid output line 26.

Figure 2:
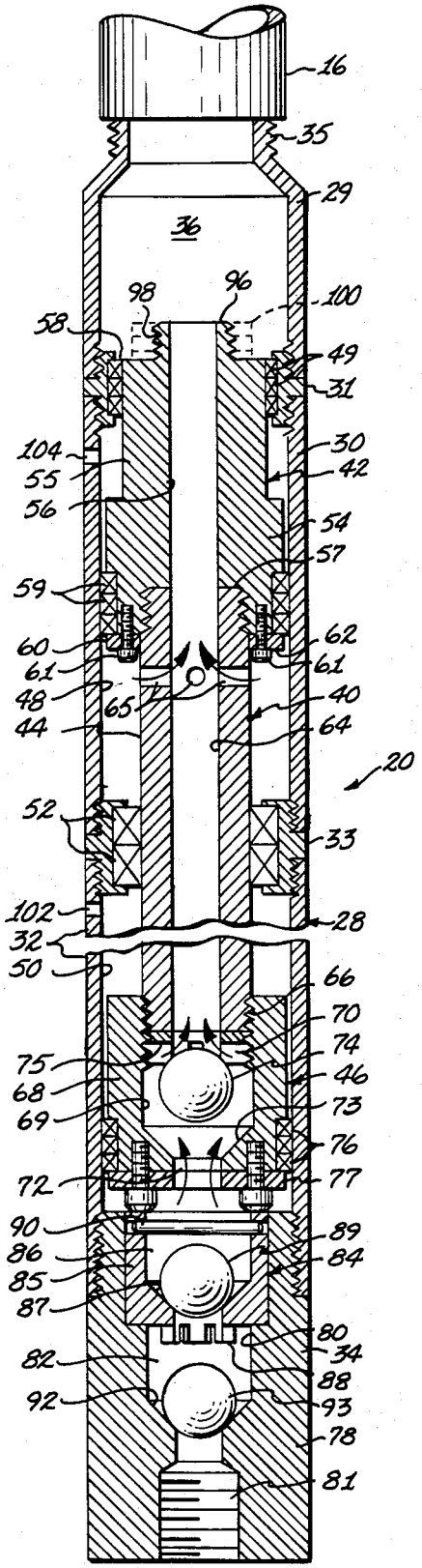
FIG. 2 is a fragmentary longitudinal sectional view through the liquid elevating mechanism of FIG. 1 and showing the mechanism in its downstroke position.

Referring now to FIG. 2, wherein the first embodiment of the liquid elevating mechanism 20 is shown in its normal, or downstroke position. This normal downstroke position occurs in the absence of sonic pressure wave pulses.

The liquid elevating mechanism 20 includes an elongated cylindrical housing 28 consisting of an upper adapter housing 29, a first cylindrical housing segment 30, threadingly depending therefrom by means of a first special union 31, a second cylindrical housing segment 32 threadingly coupled to the lowermost end of the first segment 30 by means of a special union 33 and a special liquid inlet end fitting 34 which is threadingly carried on the lower end of the second cylindrical housing segment.

The adapter housing 29 is provided with fitting means 35 on its upper end, such as the illustrated threaded boss, by which cylindrical housing 28 is demountably attached to the lower end of the production tube 16. The adapter housing 29 defines an internal chamber 36 which receives the sonic pressure waves from the production tube 16 and also directs the pumped liquid upwardly into the production tube.

As will hereinafter be described in detail, a plunger assembly 40 is reciprocally mounted in the cylindrical housing 28 and includes a counterbalancing piston 42 which is connected by means of a depending tubular stem 44 to a production piston 46.

The bore 48 of the first cylindrical segment 30 defines a cylinder bore in which the counterbalancing piston 42 is reciprocally movable. The cylinder bore 48 is separated from the internal chamber 36 of the adapter housing 29 by the annular seals 49 carried in the union 31, so as to sealingly engage the periphery of the counterbalancing piston 42. The bore 50 of the second cylindrical housing segment 32 defines a cylinder bore in which the production piston 46 is reciprocally movable, with the cylinder bore 50 being separated from the cylinder bore 48 by annular seals 52 carried in the second special union 33 so as to sealingly bear on the periphery of the tubular stem 44 which interconnects the counterbalancing piston 42 and the production piston 46 of the plunger assembly 40.

The counterbalancing piston 42 includes a piston body having a relatively large diameter lower portion 54 with an integral axially upwardly extending reduced diameter portion 55. An axial bore 56 is formed through the piston body and is counterbored at the lower end of the piston body and internal threads 57 are provided in the counterbore for threadingly receiving the upper end of the depending tubular stem 44. The periphery of the upper reduced diameter portion 55 of the counterbalancing piston 42 is in sealed engagement with the hereinbefore mentioned annular seals 49 which places the upper end surface 58 of the counterbalancing piston in the internal chamber 36 of the adapter housing 29. The lower relatively larger diameter portion 54 of the counterbalancing piston is formed with a suitable annular shoulder to carry the annular seals 59 which are held in place by a seal retaining plate 60 that is affixed to the piston body by suitable cap screws 61. The seal plate 60, cap screws 61 and the exposed downwardly facing portion of the lowermost one of the annular seals 59 cooperatively form the downwardly facing end surface 62 of the counterbalancing piston 42 which is located in the cylinder bore 48 defined by the first cylindrical housing segment 30.

The tubular interconnecting stem 44 is threadingly carried in the counterbore at the bottom end of the counterbalancing piston 42, as hereinbefore mentioned, with the bore 64 thereof being in axial alignment with the bore 56 of the counterbalancing piston 42. The stem 44 is provided with radial apertures 65 proximate its upper threaded end which places the bore 64 of the stem in liquid communication with the portion of the cylinder bore 48 that is below the counterbalancing piston 42. The lower threaded end 66 of the tubular interconnecting stem 44 is threadingly attached to the production piston 46.

Figure 3:
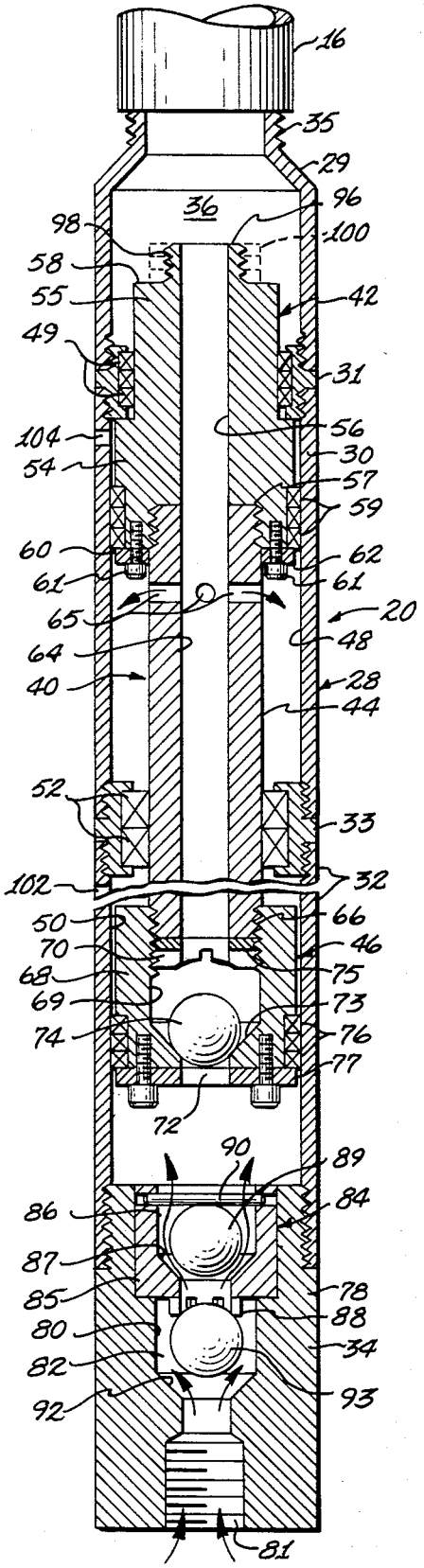
FIG. 3 is a fragmentary longitudinal sectional view similar to FIG. 2 but showing the liquid elevating mechanism in its upstroke position.

The production piston 46 includes a piston body 68 having an axial bore 69 formed therethrough which is internally threaded at its upper end for threadingly receiving a ball valve cage 70 and the lower end 66 of the interconnecting stem 44 so that the bore 69 is in axial alignment with the bore 64 of the stem 44. The axial bore 69 is of reduced diameter at its lower end 72 which provides a liquid inlet, and the transition area between the inlet end 72 and the upwardly disposed diametrically larger bore portion is formed as a valve seat 73 for a ball valve 74 provided in the bore. As will hereinafter be described in detail, the ball valve 74 will be seated in the valve seat 73 when the plunger assembly 40 is moving upwardly as seen in FIG. 3, and will move off of the valve seat 73 into engagement with the ball valve cage 70 when the plunger assembly moves down as shown in FIG. 2. The ball valve cage 70 is a plug-like fitting having a plurality of radial slots 75 in its lower end so as to insure the free upward flow of liquid when the ball valve 74 is in the unseated position thereof, i.e., in engagement with the cage 70. A downwardly facing annular shoulder is formed in the production piston body 68 for mounting of annular seals 76 which sealingly engage the walls of the cylinder bore 50 with the seals being held in position by a seal retainer plate 77 which is mounted on the bottom of the body 68 by suitable cap screws and which is formed with a central opening.

The liquid inlet end fitting 34 includes a cylindrical housing 78 which is threaded at its upper end for attachment to the lower end of the second cylindrical housing segment 32. The housing 78 has an axial bore 80 formed therethrough of suitable configuration to provide a threaded bore portion 81 at the lower end thereof, an intermediate valve chamber 82 and an upper chamber for receiving an upper check valve assembly 84.

The check valve assembly 84 includes a housing 85, which may be pressed or otherwise mounted in the upper chamber of the bore 80. The housing 85 is formed with an axial bore which defines a ball valve chamber 86, a seat 87 and a reduced diameter downwardly extending slotted boss 88 which forms a cage for the valve immediately below as will be described. A ball valve 89 is mounted in the chamber 86 and a pin 90 is mounted in the housing 85 so as to transversely span the chamber 86, with the pin 90 serving to prevent the ball valve 89 from being dislodged from the chamber 86.

The intermediate valve chamber 82 is formed with a valve seat 92 in its lower end and a ball valve 93 is mounted in that chamber. The above mentioned slotted boss cage 88 protrudes into the intermediate valve chamber 82 to insure a free flow of liquid when the ball valve 93 is not seated. When the plunger assembly 40 is moving down, both of the ball valves 89 and 93 will be in seated engagement with their respective valve seats 87 and 92, as shown in FIG. 2, and when the plunger assembly moves upwardly, both ball valves 89 and 93 will be off of their respective valve seats as seen in FIG. 3.

The threaded bore portion 81 provided at the lower end of the inlet fitting 34 is so configured so that a suitable sediment filter (not shown) may be added if desired or needed.

Operation

With the liquid elevating mechanism 20 connected by the production tube 16 to the sonic pressure wave generator 14 and installed in a well, as shown in FIG. 1, the liquid column (not shown) will exert a head pressure on the plunger assembly 40. The head pressure is sensed by the upwardly facing end surface 58 of the counterblancing piston 42, thus exerting a downwardly directed force thereon. That head pressure is, however, also sensed by the larger surface area downwardly facing end surface 62 of the counterbalancing piston 42 by virtue of the bore 56 of the counterbalancing piston 42, the bore 64 and the radial apertures 65 of the stem, thus placing an upwardly directed force thereon. Since the bottom end surface 62 has a larger surface area than the upper end surface 58, the net result will be an upwardly directed force applied to the counterbalancing piston 42. It will be noted that the counterbalancing piston body is shown as being quite massive, and the weight of this piston 42 along with the weight of the interconnecting tubular stem 44 and the production piston 46 places a downwardly directed force on the plunger assembly 40 which is additive with the head pressure force sensed by the top surface 58 of the counterbalancing piston 42.

As will hereinafter be shown more specifically, the weight of the plunger assembly 40 is intentionally preset so that this weight, plus the downwardly exerted head pressure force is somewhat greater than the upwardly exerted head pressure force. Therefore, the plunger assembly 40 will be normally biased to its downstroke position, as shown in FIG. 2.

When a sonic pressuure wave enters the liquid elevating mechanism 20, the force thereof will be sensed by both of the opposite ends 58 and 62 of the counterbalancing piston. Due to the area differential of those end surfaces, the plunger assembly will move upwardly against the biasing force to its upstroked position shown in FIG. 3.

To insure a clear understanding of the above described biased counterbalancing, an example of the relative area sizes, head pressure forces, and weight will now be presented.

In this example, it will be assumed that the top end surface 58 of the counterbalancing piston 42 has an area of 4.4301 Sq. inches ($\pi \times 1.875^2$), and the bottom end surface 62 has an area of 7.0686 Sq. inches ($\pi \times 2.25^2$), less the area of the interconnecting tube, 1.7671 Sq. inches ($\pi \times 0.75^2$), for an effective bottom surface area of 5.3015 Sq. inches (7.0686−1.7671). The differential area will be seen to be 0.8714 Sq. inches (5.3015−4.4301), i.e., the bottom end surface 62 will be 0.8714 Sq. inches larger than the top end surface area. Now it will be assumed that the liquid elevating mechanism 20 is installed in a well at the depth of 1000 feet. The head pressure at such a depth is 433.5 PSI. Therefore, by multiplying the head pressure by the differential area (433.5×0.8714) it will be seen that a force of 377.76 pounds will be pushing up on the plunger assembly 42. With a cumulative weight of the counterbalancing piston 42, stem 44 and production piston 46 of 377.76 pounds, the plunger assembly 40 would be perfectly counterbalanced. Therefore, to accomplish the above described biasing of the plunger assembly 40, the cumulative weight thereof must be in excess of the 377.76 pounds. Further, this excess amount of weighyt must be sufficient to allow gravitational forces to move the plunger assembly downward through the seals 49, 59, 52 and 76, and through the liquid being pumped. The viscosity of the liquid being pumped must, of course, be considered, but for most well installations an excess weight of between 50 and 60 pounds would work satisfactorily.

It should be noted that the numerical values of the above example are given merely to clarify the biased counterbalancing function of the liquid elevating mechanism 20 of the present invention. In actuality, the counterbalancing piston 42 would be configured to provide a differential area significantly smaller than that of the above example to reduce the required weight values.

It will be appreciated that the liquid elevating mechanism 20 will not always be operated at the same depth which means that the head pressure on the mechanism 20 will not always be the same. For wells having a depth less than the 1000 feet of the above example, the head pressure will be less than 433.5 PSI, and similarly, at depths over 1000 feet the head pressure will be larger. For this reason, the counterbalancing piston 42 is provided with means 96 by which weight may be added to or removed from the plunger assembly 40. Any suitable means will do, such as the illustrated externally threaded boss 98 extending axially upwardly from the top surface 58 of the counterbalancing piston. Additional weights 100 shown in phantom lines, may be threadingly added or removed from the boss 98 as determined by the depth of the well in which the liquid elevating mechanism 20 is to be installed.

When the plunger assembly 40 moves down, from the position shown in FIG. 3, to that shown in FIG. 2, under the influence of gravity, the two ball check valves 89 and 93 of the inlet end fitting 34 will close to prevent liquid flow out of the liquid elevating mechanism 20. The ball check valve 74 of the production piston 46 will open and the liquid in the cylinder bore 50 below the production piston 46 will flow up into the axial bore of the plunger assembly.

It will be noted that a vent port 102 is provided in the upper end of the second cylindrical housing segment 32 which allows air from within the well casing 18 (FIG. 1) to enter the cylinder bore 50 during the downstroke of the plunger assembly 40, and will let air escape during the upstroke. This, of course, prevents a partial vacuum from being formed during the downstroke and prevents dashpotting during an upstroke.

The downward movement of the plunger assembly 40 will also cause the liquid in the cylinder bore 48 below the counterbalancing piston 42 to move through the radial apertures 65 of the interconnecting stem 44 and upwardly into the axial bore of the plunger assembly. The liquid which moves into the axial bore of the plunger assembly 40 during its downstroke, will move upwardly therethrough into the chamber 36 of the adapter housing 29, where it is carried upwardly by the reflected sonic pressure waves as hereinbefore described.

When the plunger assembly 40 moves upwardly, from the illustrated position of FIG. 2 to that shown in FIG. 3, in response to a sonic pressure wave, the ball check valve 74 of the production piston 46 will close to prevent liquid in the axial bore of the plunger assembly from moving back down into the cylinder bore 50 below the production piston 46. The two bottom check valves 89 and 93 will open and liquid from the subterranean source will be drawn into the lower portion of the cylinder bore 50 as a result of the upward movement of the production piston.

The upward movement of the plunger assembly will also allow the liquid in the axial bore thereof to flow into the lower portion of the cylinder chamber 48 through the radial apertures 65 of the interconnecting stem 44. The liquid elevating mechanism 20 is then fully charged with liquid to be pumped to the ground surface at the occurrence of the subsequent downstroke as hereinbefore described.

It will be noted that the first cylindrical housing segment 30 is provided with a vent port 104 proximate its upper end. This vent port 104 functions and is for the same purpose as the previously described vent port 102.

Figure 4:
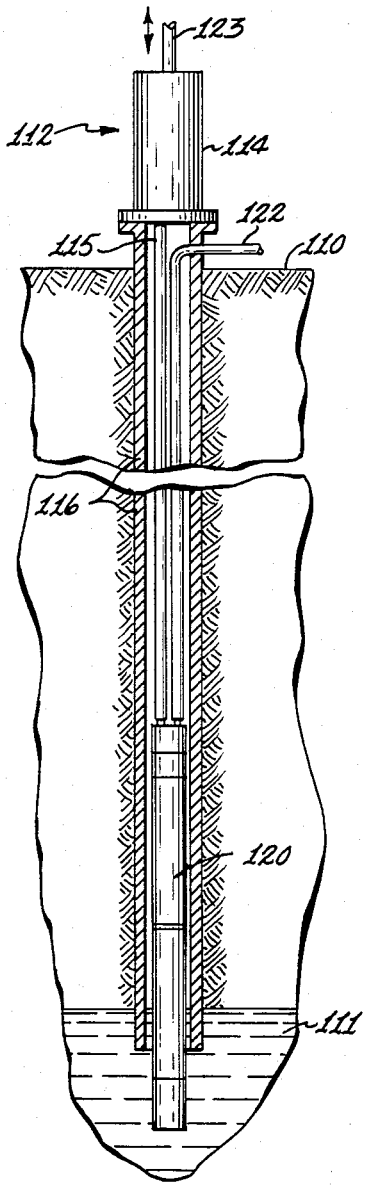
FIG. 4 is a diagrammatic view illustrating a typical hydraulic pressure wave two tube surface operated pump in a well installation with the pump being provided with a second embodiment of the improved liquid elevating mechanism of the present invention.

FIG. 4 illustrates a ground formation having a surface level 110 and an underground level 111 containing liquid which is to be pumped, such as oil, water, or the like. A hydraulic pressure wave two tube surface operated pump 112 is located in the ground formation in the conventional manner, and includes an above ground hydraulic pressure wave generator 114 from which a hydraulic signal transmitting tube 115 depends. The signal tube 115 extends downwardly from the generator 114 through a conventional well casing 116 with the second embodiment of the liquid elevating mechanism 120 of the present invention mounted on the lower end thereof so that the bottom end of the liquid elevating mechanism 120 is in liquid communication with the underground liquid. A second tube 122 is connected to the liquid elevating mechanism 120 and extends upwardly therefrom through the well casing 116 to the above ground level. The second tube 122 is referred to as the production tube for reasons which will become apparent as this description progresses.

The above ground generator 114 is a reciprocally drivable mechanism wherein a suitable drive means (not shown) is appropriately coupled to the shaft 123 which drives a piston (not shown) so that it cyclically impacts a column of liquid (not shown) which is contained in the liquid elevating mechanism 120, the signal tube 115 and in the lower portion of the generator itself. It will be noted that the production tube 122 also contains a column of liquid. The pressure waves generated by the generator 114 are hydraulic in nature and are transmitted downwardly through the liquid column of the signal tube 115, operate the liquid elevating mechanism 120 which, in response thereto, will liftingly pump the liquid to the ground surface through the production tube 122.

Figure 5:
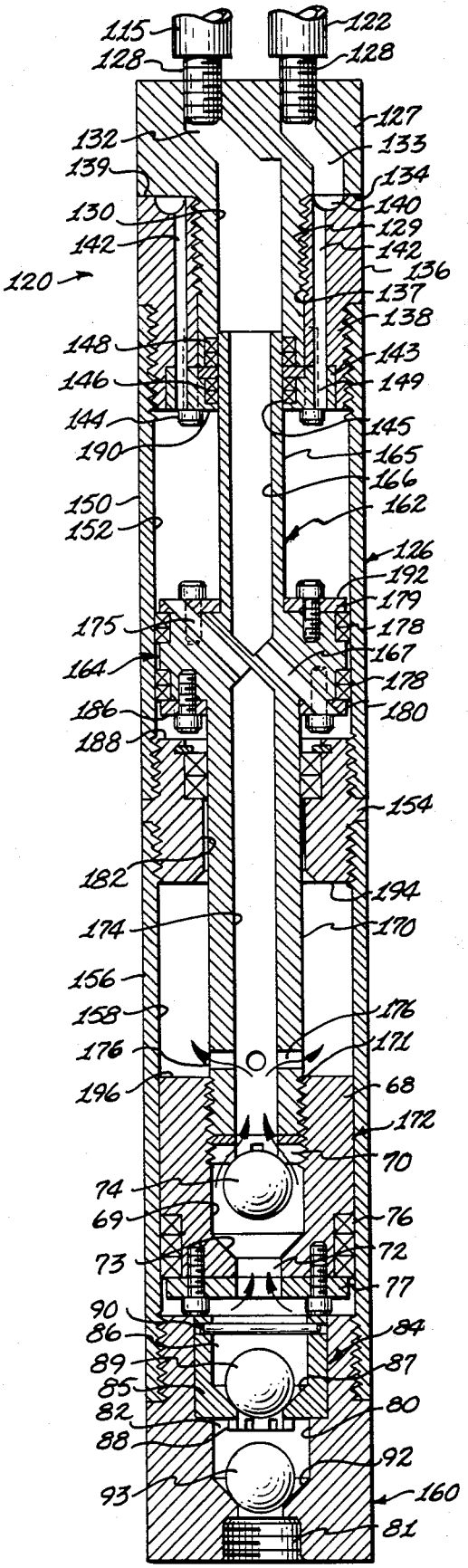
FIG. 5 is a longitudinal sectional view taken through the liquid elevating mechanism of FIG. 4 and showing the mechanism in its downstroke position.
Figure 6:
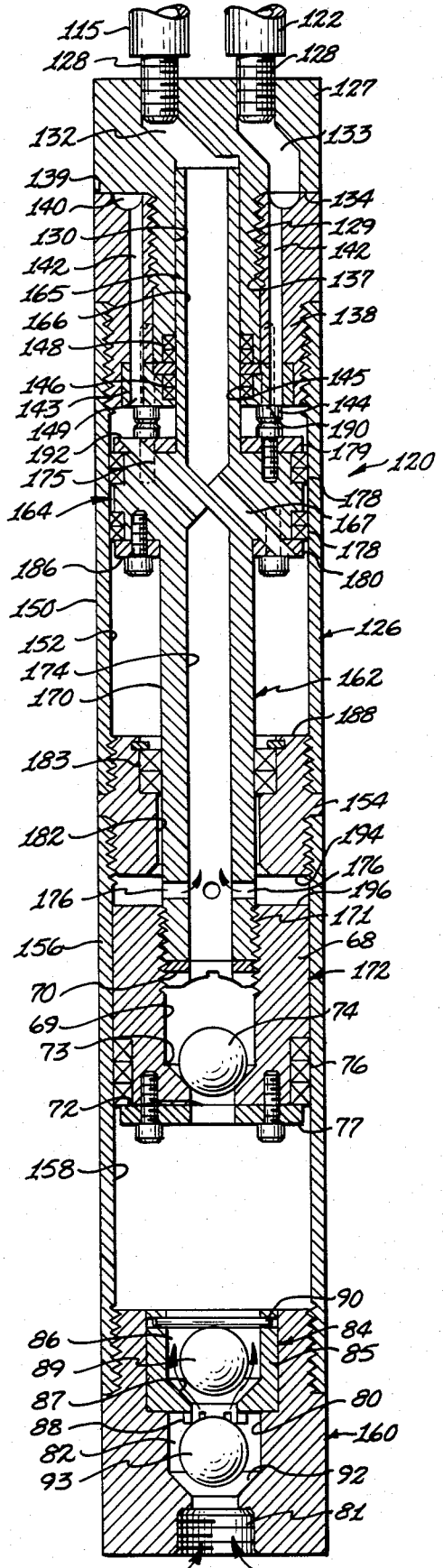
FIG. 6 is a longitudinal sectional view similar to FIG. 5 but showing the liquid elevating mechanism in its upstroke position.

The liquid elevating mechanism 120 of this second embodiment of the present invention, as seen in FIGS. 5 and 6, includes an elongated cylindrical housing 126 having an upper coupling housing 127 to which the signal and production tubes 115 and 122, respectively, are suitably connected such as by the illustrated unions 128. The housing 127 is formed with an externally threaded axially depending boss 129 which defines a bore 130, with the bore 130 being in liquid communication with the signal tube 115 via a first passage 132 formed in the housing. A second passage 133 is formed in the housing 127, so as to open downwardly onto a shoulder 134, with the production tube 122 being in liquid communication with the second passage 133.

An adapter housing 136 is provided with an internally threaded bore 137 and a reduced diameter externally threaded lower portion 138. The adapter housing 136 has its threaded bore 137 threadingly mounted on the depending boss 129 of the coupling housing 127 so that its upper surface 139 is in contiguous engagement with the downwardly facing shoulder 134 of the coupling housing 127. An annular groove 140 is formed in the upper surface 139 of the adapter housing 136 and at least a pair of passages 142 extend downwardly from the groove 140 through the housing. The bottom surface of the adapter housing 136 is axially counterbored to receive a seal plate 143 which is mounted therein by suitable screws 144. The seal plate 143 is provided with an axial bore 145 which aligns with the bore 130 of the coupling housing 127, with seals 146 being suitably mounted in the seal plate so as to circumscribe its axial passage. It will be noted that the lower end of the depending boss 129 is axially counterbored to contain seals 148 so that they circumscribe the bore 130 of the coupling housing 127, and are retained therein by the seal plate 143. At least a pair of passages 149 are also formed through the seal plate 143 and are disposed so that each passage aligns with a different one of the passages 142 of the adapter housing 136.

A first cylindrical housing segment 150 is threadingly attached to the threaded lower portion 138 of the adapter housing 136 so as to coaxially depend therefrom. The housing segment 150 defines a cylinder bore 152 and has a special union 154 threadingly mounted in its lower end. A second cylindrical housing segment 156 is threadingly attached to the union 154 so as to coaxially depend therefrom, with this second housing segment 156 defining a cylinder bore 158. The lower end of the second cylindrical housing segment 156 is internally threaded and a liquid inlet end fitting 160 is mounted therein.

The end fitting 160 is identical to the hereinbefore described end fitting 34 and therefore includes the upper check valve assembly 84 having the ball check valve 89 mounted therein, an intermediate valve chamber 82 in which the ball check valve 93 is mounted, and a threaded bore portion 81 which opens downwardly so as to be in liquid communication with the liquid to be pumped.

A plunger assembly 162 is reciprocally mounted in the liquid elevating mechanism 120 and includes a counterbalancing piston 164 which is disposed in the upper cylinder bore 152. An elongated shaft 165 is formed so as to extend axially upwardly from the counterbalancing piston 164. The shaft is slidably mounted in the axial bore 130 of the coupling housing 127 with the seals 148 of that housing and the seals 146 of the seal plate 143 being in sealing engagement with the periphery of the shaft 165. The shaft 165 is provided with an upwardly opening axial bore 166 which extends therethrough into the counterbalancing piston 164 and is in liquid communication with a first angular passage 167 formed in the counterbalancing piston so as to open downwardly into the cylinder bore 152 below the counterbalancing piston 164.

From the above, it will be seen that the signal transmitting tube 115 is in liquid communication with that portion of the cylinder bore 152 which is below the counterbalancing piston 164 via the passage 132 and axial bore 130 of the coupling housing 127, the bore 166 of the shaft 165 and the first angular passage 167 of the counterbalancing piston 164.

The counterbalancing piston 164 is further provided with an axially depending stem 170 having its lower end 171 externally threaded for attachment to a production piston 172 which will hereinafter be described. The stem 170 defines a downwardly opening axial bore 174 which extends upwardly into the counterbalancing piston 164 and is in liquid communication with a second angular passage 175 formed through the counterbalancing piston 164 so as to open upwardly into that portion of the cylinder bore 152 which is above the counterbalancing piston. The depending stem 170 is provided with a plurality of radial apertures 176 proximate its lower end 171 which places the bore 174 of the stem 170 in liquid communication with that portion of the cylinder bore 158 which is above the production piston 172. Therefore, the production tube 122 is in liquid communication with the portion of the cylinder bore 152 which is above the counterbalancing piston 164 by virtue of the passages 133 and 142, and is also in liquid communication with that portion of the cylinder bore 158 which is above the production piston 172 by virtue of the angular passage 175, the stem bore 174, and the radial apertures 176.

The counterbalancing piston 164 is suitably configured for the mounting of annular seals 178 on the periphery thereof, with the seals 178 being retained by an upper seal plate 179 and a lower seal plate 180 which are mounted on the piston by suitable cap screws.

The previously mentioned special union 154, which interconnects the first and second cylindrical housing segments 150 and 156, respectively, also sealingly isolates the cylinder bore 152 from the cylinder bore 158 by sealingly engaging the periphery of the axially depending stem 170 of the counterbalancing piston 164. The union 154 has an axial bore 182 in which the stem 170 is axially movable with the bore 182 being counterbored for the mounting of suitable annular seals 183 therein. The seals 183 are held in place such as by a suitable snap ring and are in sealed bearing engagement with the periphery of the stem 170.

The production piston 172 is identical to the hereinbefore fully described production piston 46 and therefore includes the axial bore 69 which is coaxial with the bore 174 of the depending stem 170. The ball check valve 74 is disposed within the axial bore 69 which is configured to provide the valve seat 73. As in the case of the production piston 46, the ball check valve 74 of the production piston 172 will be open when the plunger assembly 162 is moved downwardly and will be closed when the plunger assembly is moved upwardly.

Operation

The head pressure exerted by the column of liquid in the signal tube 115 on the liquid elevating mechanism 120 is substantially equal to the head pressure exerted thereon by the liquid column in the production tube 122.

The head pressure resulting form the liquid column in the signal tube 115 is exerted on the downwardly facing surface 186 of the counterbalancing piston 164 and on the upwardly facing surface 188 of the special union 154. Since those surfaces 186 and 188 are substantially equal in area, no movement or biasing of the plunger assembly will result from this head pressure alone.

The head pressure resulting from the liquid column in the production tube 122 is exerted on the downwardly facing surface 190 formed by the lower end of the adapter housing 136 and the seal plate 143 mounted therein, and on the upwardly facing surface 192 of the counterbalancing piston 164. This same head pressure is also exerted on the downwardly facing surface 194 of the special union 154 and on the upwardly facing surface 196 of the production piston. The area of the surface 190 is substantially equal to the area of surface 192, and the area 194 is substantially equal to the area of surface 196. Therefore, no movement, or biasing of the plunger assembly 162 will result from this head pressure alone.

As shown, the diameter of the upwardly extending shaft 165 of the counterbalancing piston 164 is smaller than the diameter of the depending stem 170 thereof. Therefore, the upper surface 192 of the counterbalancing piston 164 has a larger surface area than that of the lower surface 186 of the piston 164. Therefore, even though the two head pressures are substantially equal, the larger surface area of the upper surface 192 of the counterbalancing piston 164 causes the plunger assembly 162 to be biased downwardly to the position shown in FIG. 5. This downward biasing of the plunger assembly 162 is its normal position, in other words, the plunger assembly is biased downwardly in the absence of the hydraulic pressure waves generated by the generator 114 and transported downwardly to the liquid elevating mechanism 120 by the signal tube 115.

When a hydraulic pressure wave arrives in the liquid elevating mechanism 120, the increased pressure, i.e., head pressure plus the hydraulic pressure wave, will be exerted on the downwardly facing surface 186 of the counterbalancing piston 164 and will cause the plunger assembly 162 to move upwardly to the position shown in FIG. 6 against the above described biasing force. Therefore, the plunger assembly 162 will move up upon the occurrence of each of the cyclic hydraulic pressure waves, and will move down between the occurrences of those pressure waves.

When the plunger assembly 162 moves down, from the position shown in FIG. 6 to the position shown in FIG. 5, the two ball check valves 89 and 93 of the inlet end fitting 160 will close to prevent liquid flow out of the liquid elevating mechanism 120. The ball check valve 74 of the production piston 172 will open and the liquid in the cylinder bore 158 below the production piston will flow upwardly through the open ball check valve 74 of the production piston 172 into the axial bore 174 of the stem 170. The liquid received in the stem bore 174 will flow through the radial apertures 176 thereof into the cylinder bore 158 above the production piston 172 to fill the void created therein by the downward movement of the production piston. The same liquid received in the bore 174 of the stem 170 will also produce a general upward movement of the liquid column in the bore 174 of the stem 170, the angular passage 175 of the counterbalancing piston 164 so that the void created in the cylinder bore 152 above the counterbalancing piston 164, upon downward movement thereof, will be filled with the upwardly moving liquid.

When the plunger assembly moves upwardly, the ball check valve 74 of the production piston 172 will close and the two lower ball check valves 89 and 93 will be opened to allow the subterranean liquid to enter into that portion of the cylinder bore 158 below the upwardly moving production piston. The upwardly moving production piston 172 will force the liquid in that portion of the cylinder bore 158 which is above the production piston to move through the radial apertures 176 into and upwardly through the axial bore 174 of the depending stem 170 into that portion of the cylinder bore 152 which is above the counterbalancing piston 164. Since, however, the counterbalancing piston is also moving upwardly, the liquid in the cylinder bore 152 above the counterbalancing piston 164, and the liquid arriving therein from the stem bore 174, will be forced upwardly through the passages 142 and the annular groove 140 of the adapter housing into the second passage 133 of the coupling housing 127 into the production tube 122 causing a general upward movement of the liquid column therein.

From the above, it will be seen that the operation of the liquid elevating mechanism 120 is dependent on the separation of the signal tube 115 from the production tube 122. The need for two separate tubes is expensive from both initial cost and maintenance standpoints, and this shortcoming can be overcome to some extent by utilization of an accumulator mechanism 200 as seen in FIGS. 7 and 8.

Figure 7:
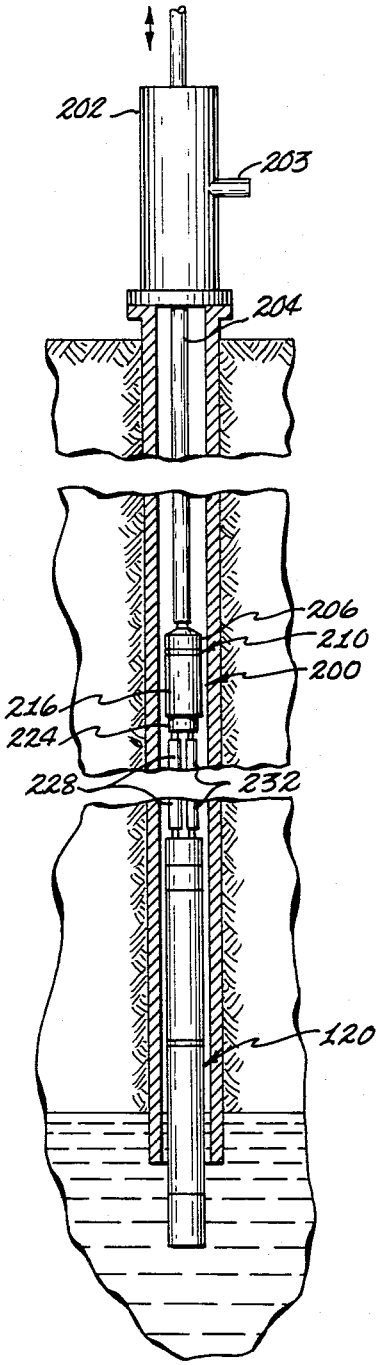
FIG. 7 is a diagrammatic sectional view showing a hydraulic pressure wave surface operated pump in a well installation and provided with the liquid elevating mechanism of FIGS. 4, 5 and 6 which is used in conjunction with an accumulator mechanism which allows one of the tubes of such pumps to be eliminated over the greatest part of the depth of the well.

FIG. 7 shows an above ground hydraulic pressure wave generator 202 which is reciprocally driven in the manner hereinbefore described. The generator is provided with a liquid outlet line 203 which is cyclically opened and closed as a result of the reciprocal motion of the generator piston (not shown). The generator piston (not shown) cyclically impacts a column of liquid contained in the generator 202 and in a single tube 204 which extends downwardly from the generator to the accumulator 200.

Figure 8:
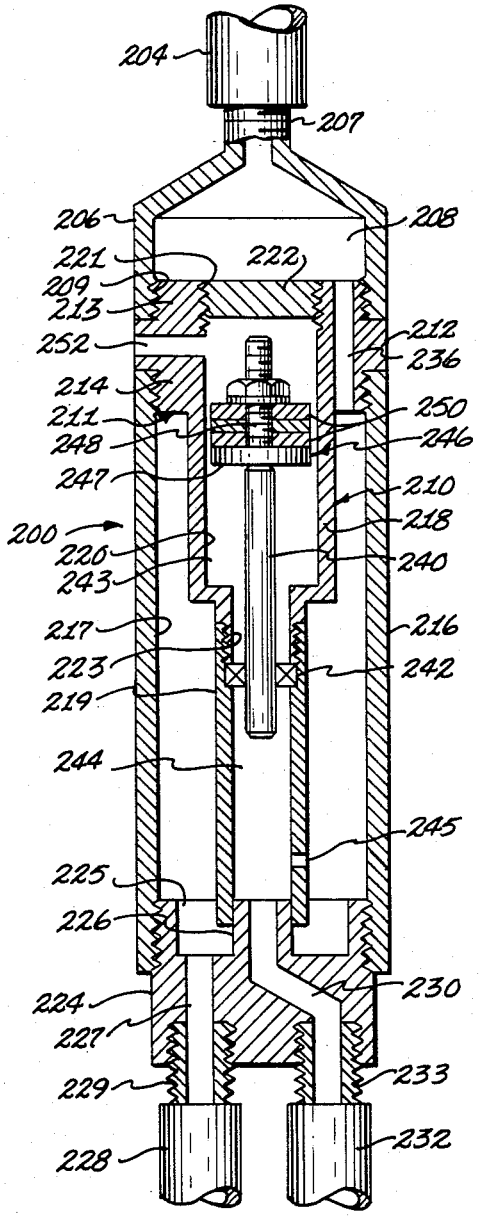
FIG. 8 is a longitudinal sectional view of the accumulator of FIG. 7.

As seen best in FIG. 8, the accumulator 200 has a cylindrical accumulator housing assembly which includes an adapter housing 206 having a fitting means 207 on its lower end for connection to the lower end of a single tube 204. The housing 206 defines a chamber 208 with internal threads 209 formed in the lower end thereof. A housing body 210 of special configuration is provided with a union-like fitting 211 at its upper end which has an annular flange 212 with an externally threaded boss 213 extending axially upwardly therefrom and a similar boss 214 extending axially downwardly therefrom. The special body 210 has its upper boss 213 threadingly mounted in the threads 209 of the adapter housing 206, and a cylindrical housing 216 having a bore 217 is threadingly carried on the lower threaded boss 214. The special body 210 has a first reduced diameter portion 218 depending integrally and axially from the lower threaded boss 214, and a second further diametrically reduced portion 219 depends integrally and axially from the first reduced diameter portion 218. The union-like fitting 211 and the first reduced diameter portion 218 have an axial bore 220 formed therein which is provided with internal threads 221 at the upper end for demountably receiving a plug 222. The axial bore 220 has an opening in the bottom end thereof which places it in liquid communication with a bore 223 formed through the second reduced diameter portion 219 of the housing body 210.

The cylindrical housing 216 is internally threaded at its lower end and a coupling housing 224 is threadingly carried therein. The coupling housing 224 is formed with an annular upwardly opening chamber 225 at its upper end which circumscribes an axially extending upstanding boss 226. A first passage 227 is formed through the coupling housing 224 with its upper end opening into the annular chamber 225 and having a signal tube 228 coupled to the lower end thereof such as by the illustrated fitting means 229. A second passage 230 is formed in the coupling housing 224 with its upper end passing axially through the upstanding boss 226 and a production tube 232 is coupled to the lower end of the passage 230 by fitting means 233.

The accumulator 200 is seen from the above description to be coupled to the above ground generator 202 by the single tube 204 which, as will hereinafter be described, serves to transmit the cyclic hydraulic pressure waves down to the accumulator, and transport pumped liquid to the ground surface. The accumulator 200 is coupled to the liquid elevating mechanism 120 by means of the signal tube 228 which transmits the hydraulic pressure waves from the accumulator 200 to the liquid elevating mechanism 120, and by a production tube 232 which transports the pumped liquid upwardly from the liquid elevating mechanism to the accumulator.

The single tube 204 is in direct liquid communication through the accumulator 200 with the signal tube 228 in that the internal chamber 208 of the adapter housing 206 is in liquid communication with the bore 217 of the cylindrical housing 216 by means of a passage 236 formed through the union-like fitting 211 of the housing body 210. With the chamber 208 and the bore 217 being in liquid communication with each other in this manner, they are also seen to be in liquid communication with the annular chamber 225 and the passage 227 of the coupling housing 224. Thus, it will be seen that the adapter housing 206 with its chamber 208, the passage 236, the cylindrical housing 216, its bore 217, and the coupling housing 224 with its chamber 225 cooperatively form an accumulator housing assembly which defines a bore.

As shown, the upstanding boss 226 of the coupling housing 224 is nestingly disposed within the lower end of the bore 223 of the second reduced diameter portion 219 of the housing body 210. A piston 240 is reciprocally mounted in the bore 223 and suitable seals 242 are fixedly carried in the second reduced diameter portion 219 so as to be in sealed engagement with the periphery of the piston 240. By virtue of this seal-piston arrangement, the lower portion of the bore 223 below the seals 242 provides a first cavity 244 in the body 210, and the upper portion of the bore 223 and the bore 220 cooperatively form a second cavity 243 in the body 210. The first cavity 224 of the body 210 is a pumped liquid receiving cavity in that it is in liquid communication with the production tube 232 by means of the passage 230 of the coupling housing 224. The pumped liquid receiving cavity 244 is also in communication with the bore 217 of the cylindrical housing 216 by means of an injection port 245 formed in the sidewall of the special housing body 210. The piston 240 has its lower end axially disposed within the pumped liquid receiving cavity 244 with its upper end extending axially into the second cavity 243 of the housing body 210. The upper end of the piston 240 is in bearing engagement with a weight means 246 which is disposed in the second cavity 243.

The weight means 246 is seen to include a base weight 247 having an axially upstanding threaded stud 248 for receiving ring shaped additional weights 250 on an as needed basis for head pressure counterbalancing purposes.

OPERATION

The liquid elevating mechanism 120 operates in exactly the same manner as hereinbefore fully described and therefore its operation will not be repeated.

The head pressure resulting from the column of liquid in the generator 202 and the single tube 204 is transmitted directly through the accumulator 200 to the signal tube 228 to the liquid elevating mechanism 120 by virtue of the liquid communication existing between the chamber 208, the bore 217, the annular passage 225 and the passage 227 of the coupling housing. The same head pressure is applied to the production tube 232 by virtue of the liquid communication existing between the chamber 208, the bore 217, the pumped liquid receiving cavity 244 and the passage 230 of the coupling housing.

Therefore, the head pressure is split and directed to the various locations in the liquid elevating mechanism and is utilized therein in the manner hereinbefore described in detail.

The head pressure sensed in the pumped liquid receiving cavity 244 of the housing body 210 will exert an upwardly directed force on the piston 240. The weight means 246 is appropriately weighted to overcome this upwardly directed force and bias the piston 240 downwardly.

When a hydraulic pressure wave is generated, it will be applied through the accumulator 200 to operate the liquid elevating mechanism 120 causing it to produce a general upward movement of the liquid being pumped. Thus, the pressure in the bore 217 will increase as a result of the force of the hydraulic pressure wave being added to the existing head pressure force. The pressure will increase, virtually simultaneously, in the pumped liquid receiving cavity 244 as a result of the pressure of the upwardly moving pumped liquid being added to the existing head pressure forces therein. These increases of pressure result in little, or no, liquid movement through the injection port 245 which extends between the pumped liquid receiving cavity 244 and the bore 217. The increased pressure within the pumped liquid receiving cavity 244 will exert an upwardly directed force on the piston 240 causing it to be displaced upwardly against the bias applied thereto by the weight means 246. As a result of the upward movement of the piston 240, the upwardly moving pumped liquid will be received in the cavity 244 and stored therein. When the pressure in the bore 217 diminishes, i.e., is reduced to the value of the head pressure alone, as a result of the attenuation of the hydraulic pressure wave, the stored pumped liquid in the cavity 244 will be at a relatively higher pressure and will thus flow through the injector port 245 into the bore 217 causing a general upward movement of the pumped liquid through the accumulator and the single tube 204 toward the ground surface. This injected flow of pumped liquid is augmented by the downward movement of the piston 240 which occurs when the pressure in the pumped liquid receiving cavity 244 diminishes as a result of the outflow of the liquid into the bore 217.

It will be noted that the bore 220 of the housing body 210 is vented by a passage 252, which places that bore at ambient pressure at all times. Thus, no dash pot action, or partial vacuum will occur in the bore 220 since air pressure within the well casing is sensed in that bore.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A liquid elevating mechanism for use with pumps of the type having a generator which produces cyclic pressure waves for transmission through a column of liquid to said mechanism for liquid elevating operation thereof, said liquid elevating mechanism comprising:

(a) a housing having a bore the upper end of which is for communication with the liquid column of the pump and having a liquid intake opening in the lower end thereof for communication with a liquid to be pumped;

(b) a plunger reciprocally movable in the bore of said housing for impingingly receiving the transmitted pressure waves and responding thereto by reciprocally moving, said plunger having an axial passage;

(c) check valve means in the liquid intake opening of said housing to allow the liquid to be pumped to flow into the lower end of the bore of said housing when said plunger moves upwardly therein;

(d) check valve means in the axial passage of said plunger to allow the liquid in the lower end of the bore of said housing to move into the axial passage of said plunger upon downward movement thereof;

(e) means for utilizing the head pressure force of the liquid column of the pump for counterbalancingly biasing said plunger upwardly with a force which is greater than the downwardly directed head pressure force but is less than the downwardly directed head pressure force plus the weight of the plunger so that said plunger is normally in the down position of its reciprocal stroke and will be moved up when the force of a received pressure wave is added to the counterbalancing biasing force, said means including, I. a counterbalancing piston on the upper end of said plunger, II. means in said plunger for placing the opposite end surfaces of said counterbalancing piston in communication with the head pressure force of the liquid column of the pump, III. said counterbalancing piston having its downwardly facing end surface of larger surface area than the upwardly facing end surface theeof; and (f) said plunger further including means for adjusting the weight thereof to compensate for different head pressure values of different lengths of the liquid column of the pump.

2. A liquid elevating mechanism for use with pumps of the type having a generator which produces cyclic pressure waves for transmission through a column of liquid to said mechanism for liquid elevating operation thereof, said liquid elevating mechanism comprising:

(a) a housing having a bore which defines an upper cylinder bore and a lower cylinder bore, the upper cylinder bore being for communication with the liquid column of the pump with the lower cylinder bore having a liquid intake opening for communication with a liquid to be pumped;

(b) a plunger reciprocally movable in the bore of said housing for impingingly receiving the transmitted pressure waves and responding thereto by reciprocally moving, said plunger having an axial passage;

(c) check valve means in the liquid intake opening of said housing to allow the liquid to be pumped to flow into the lower cylinder bore of said housing when said plunger moves upwardly therein;

(d) check valve means in the axial passage of said plunger to allow the liquid in the lower cylinder bore of said housing to move into the axial passage of said plunger upon downward movement thereof; and (e) means for utilizing the head pressure force of the liquid column of the pump for counterbalancingly biasing said plunger upwardly with a force which is less than the downwardly directed head pressure force plus the weight of the plunger so that said plunger is normally in the down position of its reciprocal stroke and will be moved up when the force of a received pressure wave is added to the counterbalancing biasing force, said means including, I. said plunger having a counterbalancing piston in the upper cylinder bore of said housing, II. said plunger having a production piston in the lower cylinder bore of said housing, III. said plunger having a tubular stem interconnecting said counterbalancing piston and said production piston, IV. seal means in said housing for separating the upper and lower cylinder bores thereof and in sealing engagement with the periphery of said stem of said plunger, V. said axial passage of said plunger having radial apertures below said counterbalancing piston but above said seal means so that the liquid column of said pump is in communication with both of the opposed end surfaces of said counterbalancing piston, VI. said counterbalancing piston having the surface area of its downwardly facing end surface larger than the surface area of its upwardly facing end surface.

3. A liquid elevating mechanism as claimed in claim 2 wherein the larger surface area of the downwardly facing end surface of said counterbalancing piston is sized so that the upwardly directed counterbalancing biasing force is greater than the downwardly directed force of the head pressure of the liquid column of the pump but is less than the downwardly directed force plus the weight of said plunger.

4. A liquid elevating mechanism as claimed in claim 2 and further comprising:

(a) said plunger being of a predetermined weight which moves said plunger down in opposition to the upwardly directed counterbalancing biasing force resulting from various head pressure values up to a predetermined maximum value; and (b) means for adding weight to said plunger to enable it to move down in opposition to counterbalancing biasing forces resulting from head pressure values above the predetermined maximum value.

5. A liquid elevating mechanism as claimed in claim 4 wherein said means for adding weight to said plunger includes means on the upwardly facing end surface of said counterbalancing piston for receiving at least one weight.

6. A liquid elevating mechanism as claimed in claim 5 wherein said weight has a predetermined weight value which when added to said plunger will enable it to move down in opposition to the counterbalancing biasing forces up to a predetermined value above the maximum value.

7. A liquid elevating mechanism for use with pumps of the type which produces cyclic pressure waves for transmission through a first column of liquid in a signal tube for operating said mechanism so that it elevates a liquid to be pumped in a second column of liquid, said liquid elevating mechanism comprising:

(a) a housing having a cylinder bore the upper end of which is for communication with the first and second liquid columns and having a liquid intake opening in the lower end thereof for communication with the liquid to be pumped;

(b) a plunger reciprocally mounted in the cylinder bore of said housing and including a counterbalancing piston its upper end, said plunger having an upper bore which opens onto the lower end surface of the counterbalancing piston and a lower bore which opens onto the upper end surface of the counterbalancing piston;

(c) means for placing the first liquid column in communication with the upper bore of said plunger and placing the second liquid column in communication with the lower bore of said plunger;

(d) check valve means in the liquid intake opening of said housing to allow the liquid to be pumped to flow into the lower end of the cylinder bore of said housing when said plunger moves upwardly therein;

(e) check valve means in the lower bore of said plunger to allow the liquid in the lower end of the cylinder bore of said housing to move into the lower bore of said plunger upon downward movement thereof;

(f) means for using the head pressure force of the first liquid column to counterbalancingly bias said plunger upwardly with a force which is less than the downwardly directed head pressure force of the second liquid column so that said plunger is normally in the down position of its reciprocal stroke and will move up when the force of a received pressure wave is added to the counterbalancing biasing force;

(g) an accumulator for connection to the signal tube of said pump;

(h) first tube means connected between said accumulator and said housing, said first tube means in conjunction with the signal tube of the pump providing the first liquid column through which the pressure waves are cyclically transmitted when said accumulator is connected to the signal tube of the pump;

(i) second tube means connected between said housing and said accumulator, said second tube means in conjunction with the signal tube of the pump providing the second liquid column in which the liquid to be pumped is elevated when said accumulator is connected to the signal tube of the pump;

(j) means in said accumulator for directing received cyclically transmitted pressure waves into said first tube means; and (k) means associated with said accumulator for receiving the liquid to be pumped from said second tube means and storing that liquid for subsequent injection into the signal tube of the pump between occurrences of the cyclically transmitted pressure waves.

8. A liquid elevating mechanism as claimed in claim 7 wherein said means for placing the first liquid column in communication with the upper bore of said plunger and placing the second liquid column in communication with the lower bore of said plunger comprises:

(a) said housing having a second bore extending upwardly from the cylinder bore of said housing for connection to the signal tube of the pump and opening downwardly into the upper end of the cylinder bore of said housing;

(b) a shaft extending upwardly from said plunger and having the upper bore of said plunger formed therein, said shaft movable with said plunger and disposed for axial sliding movement within the second bore of said housing; and (c) passage means formed in the upper end of said housing with one end of said passage means being for connection to the second liquid column of the pump with the other end of said passage means being open to the upper end of the cylinder bore of said housing.

9. A liquid elevating mechanism as claimed in claim 7 wherein said means for using the head pressure force of the first column of liquid to counterbalancingly bias said plunger upwardly comprises the upwardly facing end surface of the counterbalancing piston of said plunger having a surface area which is larger than the surface area of the downwardly facing end surface thereof.

10. A liquid elevating mechanism as claimed in claim 7 and further comprising:

(a) said cylinder bore of said housing defining an upper cylinder bore and a lower cylinder bore;

(b) said plunger including,

I. said counterbalancing piston in the upper cylinder bore of said housing,

II. a production piston in the lower cylinder bore of said housing,

III. a tubular stem interconnecting said counterbalancing piston and said production piston;

(c) seal means in said cylinder bore of said housing for separating the upper and lower cylinder bores defined thereby and in sealing engagement with the periphery of said tubular stem of said plunger; and (d) said counterbalancing piston having the upwardly facing end surface thereof of larger surface area than its downwardly facing end surface.

11. A liquid elevating mechanism as claimed in claim 10 wherein said lower bore of said plunger is provided with radial apertures above said production piston but below said seal means to place said lower bore in communication with the area of the lower cylinder bore of said housing which is between said production piston and said seal means.

12. A liquid elevating mechanism as claimed in claim 7 wherein said accumulator comprises an accumulator housing defining a bore with means in one end thereof for placing that bore in communication with the signal tube of the pump and means in the opposite end thereof for placing the accumulator housing bore in communication with the first tube means whereby the cyclically transmitted pressure waves are directed to said first tube means.

13. A liquid elevating mechanism as claimed in claim 12 wherein said means associated with said accumulator for receiving the liquid to be pumped comprises:

(a) a body means defining a cylinder chamber;

(b) a piston reciprocally mounted in said cylinder chamber to provide first and second cavities in the opposite ends thereof, said body means having an injection port which places said first cavity in communication with the bore of said accumulator housing;

(c) means for coupling said second tube means to said first cavity for directing the liquid to be pumped into said first cavity;

(d) biasing means in said second cavity for normally biasing said piston into said first cavity; and (e) said piston moving out of said first cavity upon receipt in said first cavity of the liquid to be pumped when the pressure in the bore of said accumulator is the sum of the head pressure of the first liquid column and the pressure of a cyclically transmitted pressure wave, said piston acting under the influence of said biasing means to move back into said first cavity to expell the received liquid to be pumped through the injection port into the bore of said accumulator when the pressure therein is reduced to the value of the head pressure of the first column of the liquid between occurrences of the cyclically transmitted pressure waves.

14. A liquid elevating mechanism as claimed in claim 13 wherein said biasing means has a force exerting value which is greater than the head pressure force of the first liquid column but is less than the combined pressure of the head pressure of the first liquid column plus the pressure of a cyclically transmitted pressure wave.

15. A liquid elevating mechanism as claimed in claim 14 wherein the force exerting capabilities of said biasing means may be altered to suit the head pressures resulting from various lengths of the first liquid column.

16. A liquid elevating mechanism as claimed in claim 14 wherein said biasing means comprises at least one weight having a predetermined weight value for moving said piston into said first cavity against various head pressures of the first liquid column up to a predetermined maximum value.

17. A liquid elevating mechanism as claimed in claim 16 wherein said body means is provided with access means by which additional weights of predetermined weight values may be added to said biasing means to increase the force exerting capabilities of said biasing means.

* * * * *